US005397627A

United States Patent [19]

Dunbar et al.

[11] Patent Number: 5,397,627

[45] Date of Patent: Mar. 14, 1995

[54] FABRIC HAVING REDUCED AIR PERMEABILITY

[75] Inventors: James J. Dunbar, Mechanicsville; Chok B. Tan, Richmond; Gene C. Weedon, Richmond; Thomas Y. Tam, Richmond; Alfred L. Cutrone, Midlothian; Elizabeth S. Bledsoe, Blackstone, all of Va.

[73] Assignee: AlliedSignal Inc., Morris Township, Morris County, N.J.

[21] Appl. No.: 207,817

[22] Filed: Mar. 8, 1994

Related U.S. Application Data

[63] Continuation of Ser. No. 959,900, Oct. 13, 1992, abandoned.

[51] Int. Cl.[6] ..... D03D 3/00

[52] U.S. Cl. ..... 428/229; 428/225; 428/227; 428/228; 428/257; 428/408; 428/902

[58] Field of Search ..... 428/225, 227, 228, 229, 428/257, 408, 902

[56] References Cited

U.S. PATENT DOCUMENTS

| | | | |
|---|---|---|---|
| 4,118,921 | 10/1978 | Adams et al. | 57/140 R |
| 4,168,298 | 9/1979 | Fitzgerald | 428/224 |
| 4,416,934 | 11/1983 | Himura et al. | 428/229 |
| 4,467,594 | 8/1984 | Eschenbach | 57/207 |
| 4,470,252 | 9/1984 | Brodmann | 57/309 |
| 4,644,622 | 2/1987 | Bauer et al. | 28/271 |
| 4,729,151 | 3/1988 | Runyon et al. | 28/276 |
| 4,737,401 | 4/1988 | Harpell et al. | 428/225 |
| 4,737,402 | 4/1988 | Harpell et al. | 428/252 |
| 4,741,151 | 5/1988 | Klink et al. | 57/350 |
| 4,748,064 | 5/1988 | Harpell et al. | 428/113 |
| 4,802,331 | 2/1989 | Klink et al. | 57/246 |
| 4,820,568 | 4/1989 | Harpell et al. | 428/113 |
| 4,850,050 | 7/1989 | Droste et al. | 2/2.5 |
| 4,858,245 | 8/1989 | Sullivan et al. | 2/21 |
| 4,900,613 | 2/1990 | Green | 428/225 |
| 4,916,000 | 4/1990 | Li et al. | 428/105 |
| 5,014,404 | 5/1991 | Smith | 28/271 |

FOREIGN PATENT DOCUMENTS

| | | |
|---|---|---|
| 0207422 | 1/1987 | European Pat. Off. . |
| 0310199 | 5/1989 | European Pat. Off. . |
| 3624115 | 1/1988 | Germany . |
| WO9104855 | 4/1991 | WIPO . |
| WO9214608 | 9/1992 | WIPO . |

*Primary Examiner*—James J. Bell
*Attorney, Agent, or Firm*—Wayne W. Rupert

[57] ABSTRACT

An article including a woven fabric for impeding the passage of air, the fabric having an air permeability of less than about 15 cfm/ft$^2$ and including at least one multifilament yarn having a longitudinal axis, the yarn being made of high strength filaments having a tenacity of at least about 7 g/d, a tensile modulus of at least about 150 g/d and an energy-to-break of at least about 8 J/g. Preferably, the high strength filaments are extended chain polyethylene.

14 Claims, 3 Drawing Sheets

FABRIC HAVING REDUCED AIR PERMEABILITY

This application is a continuation of application Ser. No. 07/959,900, filed Oct. 13, 1992, abandoned.

BACKGROUND OF THE INVENTION

The present invention relates to entangled or commingled high strength filaments and articles that include the same, particularly air impermeable articles.

Various constructions are known for articles made from high strength filaments. For example, U.S. Pat. Nos. 4,820,568; 4,748,064; 4,737,402; 4,737,401; 4,681,792; 4,650,710; 4,623,574; 4,613,535; 4,584,347; 4,563,392; 4,543,286; 4,501,856; 4,457,985; and 4,403,012 describe ballistic resistant articles which include high strength filaments made from materials such as high molecular weight extended chain polyethylene.

One type of common ballistic resistant article is a woven fabric formed from yarns of high strength filaments. For example, U.S. Pat. No. 4,858,245 broadly indicates that a plain woven, basket woven, rib woven or twill fabric can be made from high molecular weight extended chain polyethylene filament. EP-A-0 310 199 describes a ballistic resistant woven fabric consisting of high strength, ultrahigh molecular weight filaments in the weft or fill direction and a second type of filaments in the warp direction. U.S. Pat. No. 4,737,401 describes (1) a low areal density (0.1354 kg/m$^2$) plain weave fabric having 70 ends/inch in both the warp and fill directions made from untwisted high molecular weight extended chain polyethylene yarn sized with polyvinyl alcohol, (2) a 2×2 basket weave fabric having 34 ends/inch and a filament areal density of 0.434 kg/m$^2$ made from twisted (approximately 1 turn per inch ("TPI")) high molecular weight extended chain polyethylene yarn, and (3) a plain weave fabric comprised of 31 ends per inch of untwisted 1000 denier aramid yarn in both the fill and warp directions. U.S. Pat. No. 4,850,050 describes ballistic resistant fabrics made from untwisted aramid yarn having a denier per filament (dpf) of 1.68 and 1.12, respectively. A June, 1990 brochure from Akzo N. V. appears to indicate that a fabric for ballistic protection purposes could be made from a 1.33 dpf aramid yarn that is described as being "tangled".

Various constructions are also known for lightweight, flexible articles that have a certain degree of air impermeability. Such articles typically are fabrics that can be used in parachutes and sails.

Although U.S. Pat. No. 4,737,401 indicates that it might be possible to construct a ballistic resistant woven fabric from untwisted or slightly twisted yarns of high strength filaments without sizing, experience has shown that a higher amount of twist is necessary in order to obtain a commercially practical weaving performance. Increasing the amount of twist, however, tends to decrease the end use performance of the fabric, presumably for a number of reasons. First, the yarn retains a more round shape as the twist is increased, thus preventing the yarn from flattening out to provide a more compact fabric. Moreover, increased twist tends to increase the denier per filament which results in a lower cover factor. Generally, the more compact the fabric the better the air impermeability performance. Furthermore, there is a relatively high cost associated with twisting a finer denier yarn such as those with deniers of 500 or less.

Accordingly, a need exists for an article, particularly a fabric, that can be made efficiently and does not suffer from the above-mentioned drawbacks relating to air impermeability performance.

SUMMARY OF THE INVENTION

It is therefore an object of the present invention to provide a yarn and an article made from that yarn which offers improved air impermeability.

In accomplishing the foregoing objects there is provided according to the invention an article such as a parachute, sail or a glider wing that includes a woven fabric for impeding the passage of air, wherein the woven fabric includes a multifilament yarn having a longitudinal axis comprising at least one type of high strength filament selected from the group consisting of extended chain polyethylene filament, extended chain polypropylene filament, polyvinyl alcohol filament, polyacrylonitrile filament, liquid crystal filament, glass filament and carbon filament, said high strength filament having a tenacity of at least about 7 g/d, a tensile modulus of at least about 150 g/d and an energy-to-break of at least about 8 J/g, wherein the yarn includes a plurality of sections at which the individual filaments are entangled together to form entanglements and a plurality of sections wherein the individual filaments are substantially parallel to the longitudinal axis of the yarn. Preferably, the high strength filaments comprise extended chain polyethylene filaments and the entangled yarn can have a twist of less than or equal to about 2.5 TPI.

Further objects, features and advantages of the present invention will become apparent from the detailed description of preferred embodiments that follows.

BRIEF DESCRIPTION OF THE DRAWING

The invention will be described in more detail below with reference to the drawing, wherein.

DETAILED DESCRIPTION OF THE PREFERRED EMBODIMENTS

Figure 1A:
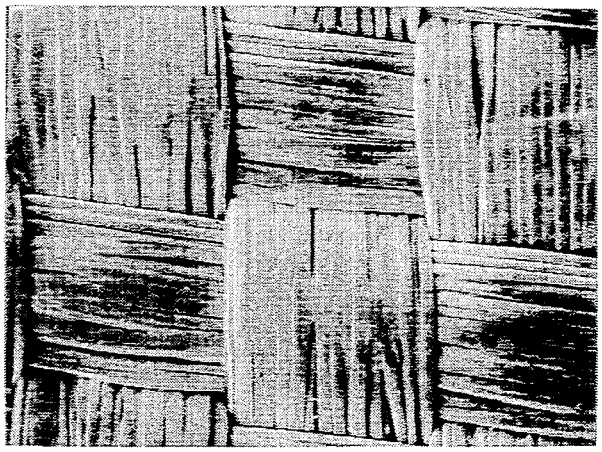
FIG. 1A is a photomicrograph of a fabric made from untwisted, entangled yarn according to the invention.

As used herein, "filament" denotes a polymer which has been formed into an elongate body, the length dimension of which is much greater than the transverse dimensions of width and thickness.

"Multifilament yarn" (also referred to herein as "yarn bundle") denotes an elongated profile which has a longitudinal length which is much greater than its cross-section and is comprised of a plurality or bundle of individual filament or filament strands.

The cross-sections of filaments for use in this invention may vary widely. They may be circular, flat or oblong in cross-section. They also may be of irregular or regular multi-lobal cross-section having one or more regular or irregular lobes projecting from the linear or longitudinal axis of the filament. It is particularly preferred that the filaments be of substantially circular, flat or oblong cross-section, most preferably the former.

The multifilament yarn of the invention includes a plurality of sections wherein the individual filaments are tightly entangled together. These sections are referred to herein as "entanglements", but are also known in the art as nips, nodes or knots. The entanglements are separated by lengths of the yarn wherein the individual filaments are not entangled but are aligned substantially parallel to each other. All or only a portion of the individual filaments in a yarn bundle can be entangled together. In general, a section of the yarn wherein at least about 30% of the filaments are entangled is considered to constitute an entanglement for purposes of this invention.

Entangling is a well known method for providing cohesion between individual continuous filament filaments as they are converted into yarn. The purpose of providing this improved cohesion is to alleviate fibrillation and friction problems which occur during processing of multifilament yarn into textile products. The term "entangling" will be used herein for convenience, but other equivalent terms used in the art such as commingling or interlacing could just as easily be substituted therefor.

An important characteristic of the yarn is the distribution of entanglements, i.e., the entanglement level. A common measure of entanglement level is entanglements per meter (EPM), which measures the average number of entanglements per meter of yarn length. The yarn of the invention has an EPM ranging from about 5 to about 55, preferrably from about 10 to about 40. If the EPM is above 55, the yarn will be damaged, and if the EPM is below 5, the weaving performance will be poor.

High strength filaments for use in this invention are those having a tenacity equal to or greater than about 7 g/d, a tensile modulus equal to or greater than about 150 g/d and an energy-to-break equal to or greater than about 8 Joules/gram (J/g). Preferred filaments are those having a tenacity equal to or greater than about 10 g/d, a tensile modulus equal to or greater than about 200 g/d and an energy-to-break equal to or greater than about 20 J/g. Particularly preferred filaments are those having a tenacity equal to or greater than about 16 g/d, a tensile modulus equal to or greater than about 400 g/d, and an energy-to-break equal to or greater than about 27 J/g. Amongst these particularly preferred embodiments, most preferred are those embodiments in which the tenacity of the filaments is equal to or greater than about 22 g/d, the tensile modulus is equal to or greater than about 900 g/d, and the energy-to-break is equal to or greater than about 27 J/g. In the practice of this invention, filaments of choice have a tenacity equal to or greater than about 28 g/d, the tensile modulus is equal to or greater than about 1200 g/d and the energy-to-break is equal to or greater than about 40 J/g.

Types of filaments that meet the strength requirements include extended chain polyolefin filament, polyvinyl alcohol filament, polyacrylonitrile filament, liquid crystalline polymer filament, glass filament, carbon filament, or mixtures thereof. Extended chain polyethylene and extended chain polypropylene are the preferred extended chain polyolefin filaments.

The extended chain polyolefins can be formed by polymerization of $\alpha,\beta$-unsaturated monomers of the formula:

$$R_1R_2{-}C{=}CH_2$$

wherein:

$R_1$ and $R_2$ are the same or different and are hydrogen, hydroxy, halogen, alkylcarbonyl, carboxy, alkoxycarbonyl, heterocycle or alkyl or aryl either unsubstituted or substituted with one or more substituents selected from the group consisting of alkoxy, cyano, hydroxy, alkyl and aryl. For greater detail of such polymers of $\alpha,\beta$-unsaturated monomers, see U.S. Pat. No. 4,916,000, hereby incorporated by reference.

U.S. Pat. No. 4,457,985, hereby incorporated by reference, generally discusses such high molecular weight extended chain polyethylene and polypropylene filaments. In the case of polyethylene, suitable filaments are those of molecular weight of at least 150,000, preferably at least 300,000, more preferably at least one million and most preferably between two million and five million. Such extended chain polyethylene (ECPE) filaments may be grown in solution as described in U.S. Pat. No. 4,137,394 or U.S. Pat. No. 4,356,138, or may be a filament spun from a solution to form a gel structure, as described in German Off. 3 004 699 and GB 20512667, and especially described in U.S. Pat. No. 4,551,296, also hereby incorporated by reference. Commonly assigned copending U.S. patent applications Ser. No. 803,860 (filed Dec. 9, 1991) and 803,883 (filed Dec. 9, 1991), both hereby incorporated by reference, describe alternative processes for removing the spinning solvents from solution or gel spun filaments such as the ones described previously.

According to the system described in Ser. No. 803,860, the spinning solvent-containing filament (i.e., the gel or coagulate filament) is contacted with an extraction solvent which is a non-solvent for the polymer of the filament, but which is a solvent for the spinning solvent at a first temperature and which is a non-solvent for the spinning solvent at a second temperature. More specifically, the extraction step is carried out at a first temperature, preferably 55° to 100° C., at which the spinning solvent is soluble in the extraction solvent. After the spinning solvent has been extracted, the extracted filament is dried if the extraction solvent is sufficiently volatile. If not, the filament is extracted with a washing solvent, preferably water, which is more volatile than the extraction solvent. The resultant waste solution of extraction solvent and spinning solvent at the first temperature is heated or cooled to where the solvents are immiscible to form a heterogeneous, two phase liquid system, which is then separated.

According to the system described in Ser. No. 803,883, the gel or coagulate filament is contacted with an extraction solvent which is a non-solvent for the polymer of the filament, but which is a solvent for the spinning solvent. After the spinning solvent has been extracted, the extracted filament is dried if the extraction solvent is sufficiently volatile. If not, the filament is extracted with a washing solvent, preferably water, which is more volatile than the extraction solvent. To recover the extraction solvent and the spinning solvent, the resultant waste solution of extraction solvent and spinning solvent is treated with a second extraction solvent to separate the solution into a first portion which predominantly comprises the first spinning solvent and a second portion which contains at least about 5% of the first extraction solvent in the waste solution.

The previously described highest values for tenacity, tensile modulus and energy-to-break are generally obtainable only by employing these solution grown or gel filament processes. A particularly preferred high strength filament is extended chain polyethylene filament known as Spectra®, which is commercially available from Allied-Signal, Inc. As used herein, the term polyethylene shall mean a predominantly linear polyethylene material that may contain minor amounts of chain branching or comonomers not exceeding 5 modifying units per 100 main chain carbon atoms, and that may also contain admixed therewith not more than about 50 weight percent of one or more polymeric additives such as alkene-1-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as antioxidants, lubricants, ultraviolet screening agents, colorants and the like which are commonly incorporated by reference.

Similarly, highly oriented polypropylene of molecular weight at least 200,000, preferably at least one million and more preferably at least two million, may be used. Such high molecular weight polypropylene may be formed into reasonably well-oriented filaments by techniques described in the various references referred to above, and especially by the technique of U.S. Pat. Nos. 4,663,101 and 4,784,820 and U.S. patent application Ser. No. 069 684, filed Jul. 6, 1987 (see published application W0 89 00213). Since polypropylene is a much less crystalline material than polyethylene and contains pendant methyl groups, tenacity values achievable with polypropylene are generally substantially lower than the corresponding values for polyethylene. Accordingly, a suitable tenacity is at least about 10 g/d, preferably at least about 12 g/d, and more preferably at least about 15 g/d. The tensile modulus for polypropylene is at least about 200 g/d, preferably at least about 250 g/d, and more preferably at least about 300 g/d. The energy-to-break of the polypropylene is at least about 8 J/g, preferably at least about 40 J/g, and most preferably at least about 60 J/g.

High molecular weight polyvinyl alcohol filaments having high tensile modulus are described in U.S. Pat. No. 4,440,711, hereby incorporated by reference. Preferred polyvinyl alcohol filaments will have a tenacity of at least about 10 g/d, a modulus of at least about 200 g/d and an energy-to-break of at least about 8 J/g, and particularly preferred polyvinyl alcohol filaments will have a tenacity of at least about 15 g/d, a modulus of at least about 300 g/d and an energy-to-break of at least about 25 J/g. Most preferred polyvinyl alcohol filaments will have a tenacity of at least about 20 g/d, a modulus of at least about 500 g/d and an energy-to-break of at least about 30 J/g. Suitable polyvinyl alcohol filament having a weight average molecular weight of at least about 200,000 can be produced, for example, by the process disclosed in U.S. Pat. No. 4,599,267.

In the case of polyacrylonitrile (PAN), PAN filament for use in the present invention are of molecular weight of at least about 400,000. Particularly useful PAN filament should have a tenacity of at least about 10 g/d and an energy-to-break of at least about 8 J/g. PAN filament having a molecular weight of at least about 400,000, a tenacity of at least about 15 to about 20 g/d and an energy-to-break of at least about 25 to about 30 J/g is most useful in producing ballistic resistant articles. Such filaments are disclosed, for example, in U.S. Pat. No. 4,535,027.

In the case of liquid crystal copolyesters, suitable filaments are disclosed, for example, in U.S. Pat. Nos. 3,975,487; 4,118,372; and 4,161,470, hereby incorporated by reference. Tenacities of about 15 to 30 g/d, more preferably about 20 to 25 g/d, modulus of about 500 to 1500 g/d, preferably about 1000 to 1200 g/d, and an energy-to-break of at least about 10 J/g are particularly desirable.

Illustrative of glass filaments that can be used in this invention are those formed from quartz, magnesia aluminosilicate, non-alkaline aluminoborosilicate, soda borosilicate, soda silicate, soda lime-aluminosilicate, lead silicate, non-alkaline lead boroalumina, non-alkaline barium boroalumina, non-alkaline zinc boroalumina, non-alkaline iron aluminosilicate and cadmium borate.

The entangled yarn can include filaments of more than one type of high strength filament. Preferably, however, the entangled yarn is formed from filaments of only one type of high strength filament. The dpf of the yarn should be at least 1.75, preferably at least 2.5, and most preferably 3.0.

If high molecular weight extended chain polyethylene filament is used to form the entangled yarn, the denier of the resulting entangled yarn should range from about 100 to about 4800, preferably from about 200 to about 650. Especially preferred are 215, 375, 430 and 650 denier multifilament yarns. The number of extended chain polyethylene filaments in a single entangled yarn can range from about 30 to 480, with about 60 to 120 filaments being especially preferred.

The entangled yarn can be formed by any conventional method for producing entangled yarns. Such methods are well known and are described, for example, in U.S. Pat. No. 4,729,151, 4,535,516, and 4,237,187 and by Demir and Acar in their "Insight Into the Mingling Process" paper presented at the Textile World Conference, October 1989, and published by the Textile Institute in *Textiles: Fashioning the Future*, all hereby incorporated by reference.

As described in these documents, entangled yarn typically is formed by an apparatus referred to as an air jet. Although there are many types of jets currently utilized such as closed jets, forwarding jets and slotting jets, all air jets generally include a yarn chamber or bore extending the length of the body which accomodates various yarn and filament deniers, at least one opening for the filaments to enter the yarn chamber, at least one opening for the resulting entangled yarn to exit the yarn chamber, and at least one air orifice which is used to direct an air flow into the yarn chamber to cause the entangling of the filaments. An air jet is presumed to form an entangled yarn as follows:

Within the air jet the loose bundle of continuous multifilament yarn is subjected to a turbulent gas stream contacting the yarn at right angles to its axis. The gas stream spreads open the filaments and, within the immediate vicinity of the spread open section, forms a plurality of vortexes which cause the filaments to become entangled. The alternating entanglement nodes and non-entangled sections are formed as the yarn travels through the chamber.

The entangled yarn is obtained by adjusting the pressure of the air striking the yarn bundle, the tension of the yarn bundle as it passes through the air jet and the air jet dimensions depending upon the type of high strength filament, the number of filaments in the yarn bundle, the desired denier of the entangled yarn and the desired level of entanglement. In each instance, the above-identified processing parameters are adjusted so that the air pressure is sufficient to separate the incoming yarn bundle and generate the vortex and resonance necessary to entangle the filaments.

There is not a limit on the number of air orifices per yarn end in the air jet, but a single, double or triple orifice air jet is preferred. The air jets also can be arranged in tandem. That is, there can be more than one air jet for each yarn end. The air jet bore can be any shape such as oval, round, rectangular, half-rectangular, triangular or half-moon. The gas stream can strike the filaments at any angle, but an approximately right angle is preferred.

One preferred double round orifice air jet has a bore which is formed by two parallel plates, the faces of which are separated equidistantly from each other by an opening which can range from about 1.5 to 3 mm. Another preferred air jet has a round orifice and an oval bore wherein the orifice diameter/bore diameter ratio is about 0.40 to 0.55, wherein the oval-shaped bore is measured at its widest diameter.

The air passing through the orifice and striking the filaments must be of sufficient pressure to achieve the degree of entanglement desired without causing any damage to the filaments. The air pressure used to produce the yarn should range from about 35 to about 55 psi.

The filaments can be transported through the air jet via any conventional method. For example, the individual filaments leaving the filament-forming apparatus such as a spinnerette could pass through draw rolls and then be collected into a yarn bundle which subsequently passes through the air jet. The entangled yarn then is sent via a guide to a winder which wraps the yarn around a bobbin or spool to form a yarn package. The winder and/or draw roll functions to control the tension of the yarn as it passes through the air jet. The preferred tension on the yarn as it passes through the air jet is about 75 to 125 g.

The entangled yarns are used to make the woven fabrics of the invention. Woven fabrics are preferred because because their end use characteristics are more controllable due to woven fabric's higher dimensional stability. The weave pattern can be any conventional pattern such as plain, basket, satin, crow feet, rib and twill. Examination of fabrics woven from entangled high molecular weight extended chain polyethylene yarn has shown that substantially all the entanglements remain in the yarn after it has been woven.

Fabrics of the present invention that can be formed from the entangled yarn may include only one type of high strength filament, preferably high molecular weight extended chain polyethylene. It is also contemplated that a fabric could include a second type of filament such as another high strength filament, which may or may not be entangled, or a filament that improves the feel or stretchability of the fabric such as nylon (e.g., Hydrofil® available from Allied-Signal), polyester, spandex, polypropylene, cotton, silk, etc. For example, entangled extended chain polyethylene filaments can be used for the warp yarn and the second filament could be used for the fill yarn, or vice versa. Regardless of what type of filament is used for the second filament, what is important to the strength of the fabric is that it includes an entangled yarn of high strength filaments in either the warp or fill direction. If the fabric is formed from extended chain polyethylene exclusively, the filament used in one direction (e.g., the warp) may be of a different tenacity, modulus, filament number, filament or total denier, twist than the filament used in the other direction (e.g., the fill).

The article of the invention includes a fabric having low air permeablity, e.g., a wind resistant fabric. The wind resistant fabric has an air permeability below about 15 cfm/ft$^2$, preferably about 10 cfm/ft$^2$, most preferably about 5.0 cfm/ft$^2$ and could be used in sails, parachutes, and gliders, and similar products. It is suspected that the improved low air permeability results from a number of unique characteristics of the entangled yarn.

In the entangled yarn, except for the relatively small areas of entanglement, the individual filaments are substantially parallel to the longitudinal axis of the yarn. In other words, it is estimated that on average about 50 to 95 %, preferably about 60 to 90%, of the total length of the yarn consists of sections wherein the individual filaments are substantially parallel to the longitudinal axis of the yarn. The phrase "substantially parallel" means that the angle between an individual filament along its running length and the longitudinal axis of the entangled yarn should be zero or as close to zero as possible without exceeding 10°, preferably 5°. FIG. 1A shows a woven fabric made from entangled yarn according to the invention wherein the individual filaments are substantially parallel to the yarn axis. The specific construction of the fabric shown in FIG. 1A is described further in this document as Inventive Example 1. It should be recognized that not all the individual filaments may be substantially parallel to the longitudinal axis of the yarn, but the number of filaments deviating from the yarn axis is sufficiently small so as to not adversely affect the properties of the yarn. This parallel filament characteristic of the entangled yarn leads to several advantages.

Figure 2A:
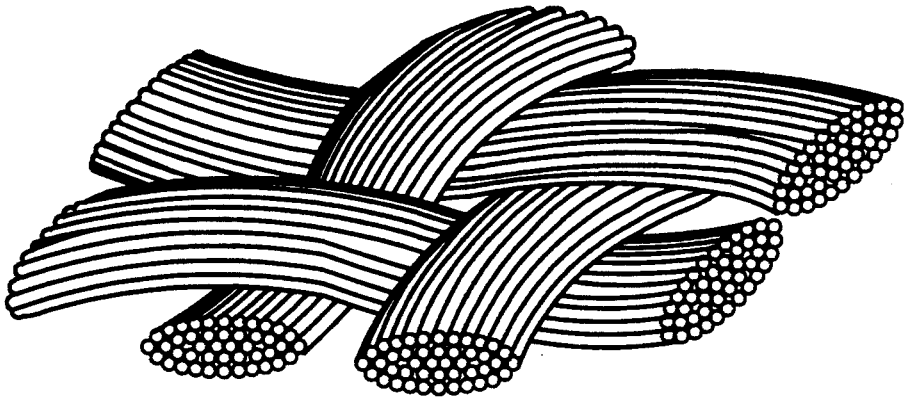
FIG. 2A is a perspective view of a fabric made from entangled yarn according to the invention.

First, the yarn tends to assume a less round or more flat profile as depicted in FIG. 2A because the friction between the individual filaments is less. A more flat profile allows for tighter weaving and allows the pick or end yarns to lie in the same plane. This tighter weave and increased planarity lowers the air permeability. The improved coverage resulting from the flattening of the yarn also allows the utilization of lower yarn end counts in a fabric leading to a lighter fabric.

The entangling contemplated in this invention not only results in the above-described advantages but also enhances the weaving performance of the yarn. As explained previously, the entanglements provide cohesion between the individual filaments. Accordingly, the entangled yarn without any further treatment such as twisting or sizing can be woven into a fabric. Indeed, the weaving performance of a high molecular weight extended chain polyethylene yarn (Spectra® 1000) which has been entangled according to the invention is superior to the weaving performance of such a yarn which has only been twisted (at least 3 TPI). Specifically, the twisted only yarn provides a running efficiency of approximately 30% and a yield of approximately 25%. The entangled yarn, however, provides a running efficiency of at least approximately 60% and a yield of at least approximately 85%. Running efficiency is the relative amount of time lost to weaving machine stoppage and yield measures the amount of yarn on a package that is converted into fabric.

Figure 1B:
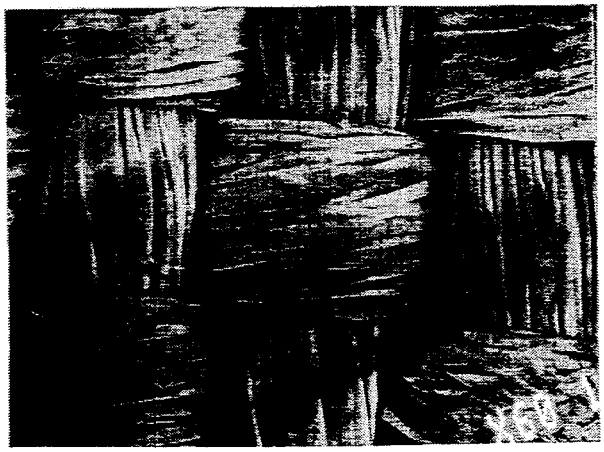
FIG. 1B is a photomicrograph of a comparative fabric made from twisted, non-entangled yarn.

Although the entangled yarn can be woven into a fabric without any further treatment, it has been found advantageous for weaving performance if twist also is applied to the entangled yarn. As mentioned previously, prior to this invention a certain amount of twist has been imparted to high strength multifilament yarns to provide efficient weaving into a fabric as shown in FIG. 1B. The fabric shown in FIG. 1B has a 56×56 plain weave construction and is made from 215 denier extended chain polyethylene yarn having a twist of 5.0 TPI in both the fill and warp directions.

Figure 2B:
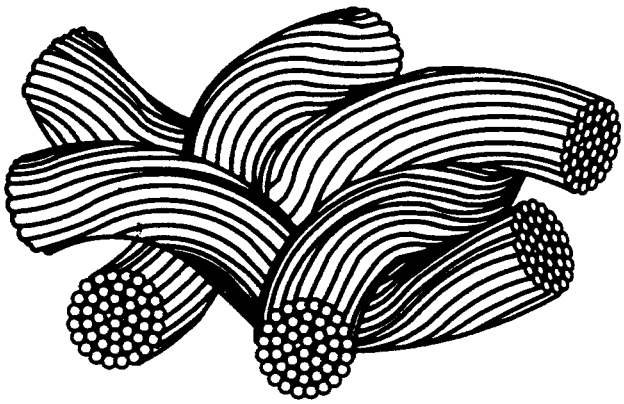
FIG. 2B is perspective view of a comparative fabric made from twisted, non-entangled yarn.
Figure 3:
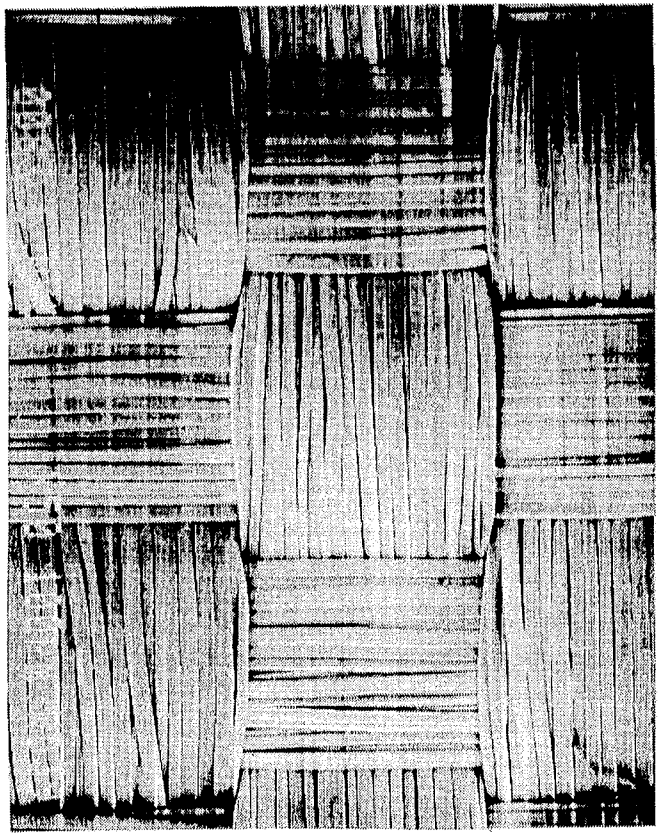
FIG. 3 is a photomicrograph of a fabric made from twisted, entangled yarn according to the invention.

Such a relatively high amount of twist, however, significantly impairs the performance of an article woven from the twisted yarn for the reasons identified above. The disadvantages of a highly twisted yarn are particularly evident when compared to the advantages of the entangled yarn of the invention. It is clear from a comparison of FIGS. 1A and 1B that twisting a yarn will impart a helical angle to the individual filaments relative to the longitudinal axis of the yarn, the consequences of which have been explained previously. In addition, comparison of FIGS. 2A and 2B makes it clear that twisting prevents the fabric from assuming a more compact form. Furthermore, the diameter of an entangled yarn having a certain denier is greater than the diameter of a twisted yarn having the same denier and, thus, the entangled yarn provides better coverage. The flattening out of the entangled, untwisted yarn also is apparent from FIG. 3 which is a 39×39 plain weave fabric made according to the invention from 375 denier extended chain polyethylene yarn (Spectra® 1000). Both the warp yarn, which runs in the vertical direction in this photomicrograph, and the fill yarn, which runs in the horizontal direction, are entangled, but the warp yarn also has 1 TPI. It is clear that the untwisted fill yarn provides greater coverage.

It has been discovered that these unique characteristics of entangled yarn of the invention compensate for the problems caused by twisting and, thus, permit the use of high strength yarn that includes a limited amount of twist. In particular, the entangled yarn of the invention can have a twist of up to about 2.5 TPI, preferably 2.0 TPI, and most preferably 0.5 TPI. This twisted entangled yarn can be used to make a fabric which has good weaving performance as well as significantly improved air impermeability performance. If the fabric is woven, the fill and/or the warp yarns can be twisted and entangled, although twisting in the warp direction only is preferred. Particularly advantageous is a fabric having as the warp yarn an entangled high molecular weight extended chain polyethylene multifilament yarn which has a twist of 1.7 TPI or 0.25 TPI and as the fill yarn an untwisted, entangled high molecular weight extended chain polyethylene multifilament yarn.

The needle pattern used for the woven fabrics made from the entangled yarn can be any conventional pattern, but a 56×56 plain weave pattern (56 yarns ends/inch in the warp direction; 56 yarn ends/inch in the fill direction) is preferred, particularly if the entangled yarn is also twisted. If the entangled yarn is not twisted, a 45×45, 34×34, or 28×56 plain weave pattern is preferred.

The advantages of the woven fabric will become more apparent from the following exemplified embodiments. Air permeability of the fabric samples was performed on a Model 9025 Air Flow Tester manufactured by United States Testing Company, Inc following the procedure set forth in the operation manual accompanying the Air Flow Tester.

COMPARATIVE EXAMPLE 1

A 60 filament, 215 denier Spectra® 1000 yarn, a high molecular weight extended chain polyethylene yarn available from Allied-Signal, was woven into a fabric using a 56×56 plain weave pattern wherein both the warp and fill yarns had a twist of 5 TPI but no entanglement.

INVENTIVE EXAMPLE 1

A 60 filament, 215 denier Spectra® 1000 untwisted yarn was woven into a fabric using a 56×56 plain weave pattern wherein both the warp and fill yarns had an entanglement level of 18 EPM. The Spectra® 1000 yarn used in this example has a tensile strength of about 26 g/d prior to entangling while the Spectra® 1000 yarn used in the other examples, including Comparative Example 1, had a tensile strength of about 36 g/d prior to entangling. The weaving performance was good.

INVENTIVE EXAMPLE 2

A 60 filament, 215 denier Spectra® 1000 untwisted yarn was woven into a fabric using a 56×56 plain weave pattern wherein both the warp and fill yarns had an entanglement level of 35 EPM. The weaving performance was adequate, but not as good as that for Inventive Example 1.

INVENTIVE EXAMPLE 3

A 60 filament, 215 denier Spectra® 1000 untwisted yarn was woven into a fabric using a 56×56 plain weave pattern wherein both the warp and fill yarns had an entanglement level of 25 EPM. The weaving performance was adequate, but not as good as that in Inventive Example 1.

INVENTIVE EXAMPLE 4

A 60 filament, 215 denier Spectra® 1000 yarn was woven into a fabric using a 56×56 plain weave pattern wherein both the warp and fill yarns had an entanglement level of 25 EPM. In addition, the warp yarn had a twist of 1.7 TPI. The fill yarn was untwisted. The weaving performance was better than that in Inventive Example 1.

INVENTIVE EXAMPLE 5

A 60 filament, 215 denier Spectra® 1000 untwisted yarn was woven into a fabric using a 45×45 plain weave pattern wherein both the warp and fill yarns had an entanglement level of 25 EPM. It was possible to weave this fabric, but the weaving performance was poor compared to the other inventive examples.

INVENTIVE EXAMPLE 6

A 60 filament, 215 denier Spectra® 1000 untwisted yarn was woven into a fabric using a 28×56 plain weave pattern wherein both the warp and fill yarns had an entanglement level of 22 EPM. The weaving performance was better than that in Inventive Examples 1, 2, 3 and 5.

INVENTIVE EXAMPLE 7

A 60 filament, 215 denier Spectra® 1000 yarn was woven into a fabric using a 56×56 plain weave pattern wherein both the warp and fill yarns had an entanglement level of 22 EPM. In addition, the warp yarn had a twist of 0.25 TPI. The fill yarn was untwisted. The weaving performance was adequate.

The results of air permeability testing performed on the above-described examples are listed in Table 1 (WR denotes application of water repellant).

TABLE 1

| | Air Permeability (scoured) (cfm/ft$^2$) | (WR) (cfm/ft$^2$) |
|---|---|---|
| Comp. Ex. 1 | 25.3 | 26.1 |
| Inv. Ex. 1 | 1.3 | 1.4 |
| Inv. Ex. 2 | 2.1 | 1.9 |
| Inv. Ex. 3 | 0.4 | 1.5 |
| Inv. Ex. 4 | 1.4 | 0.3 |
| Inv. Ex. 5 | 5.3 | 8.2 |
| Inv. Ex. 6 | 0.3 | 4.8 |
| Inv. Ex. 7 | 2.5 | 0.9 |

It is clear from Table 1 that fabrics of the invention exhibit significant improvement over the fabrics of the comparative example with respect to air impermeability.

From the foregoing description, one skilled in the art can easily ascertain the essential characteristics of this invention, and without departing from the spirit and scope thereof, can make various changes and modifications of the invention to adapt it to various usages and conditions.

We claim:

1. An article including a woven fabric for impeding the passage of air, the fabric having an air permeability of less than about 15 cfm/ft$^2$ and including at least one multifilament yarn having a longitudinal axis, the yarn comprising at least one type of high strength filament selected from the group consisting of extended chain polyethylene filament, extended chain polypropylene filament, polyvinyl alcohol filament, polyacrylonitrile filament, liquid crystal filament, glass filament and carbon filament, said high strength filament filaments having a tenacity of at least about 7 g/d, a tensile modulus of at least about 150 g/d and an energy-to-break of at least about 8 J/g, wherein the yarn includes a plurality of sections at which the individual filaments are entangled together to form entanglements and a plurality of sections wherein the individual filaments are substantially parallel to the longitudinal axis of the yarn.

2. An article according to claim 1, wherein the high strength filament comprises extended chain polyethylene.

3. An article according to claim 1, wherein the woven fabric comprises a fill yarn and a warp yarn and at least one of the fill and warp yarns is the entangled multifilament high strength yarn.

4. An article according to claim 3, wherein the fill and warp yarns both comprise extended chain polyethylene filament.

5. An article according to claim 4, wherein the entangled extended chain polyethylene yarn in at least one of the fill and warp directions has a twist of less than or equal to about 2.5 turns per inch.

6. An article according to claim 5, wherein the entangled extended chain polyethylene yarn in at least one of the fill and warp directions has a twist of less than or equal to about 2.0 turns per inch.

7. An article according to claim 4, wherein the entangled extended chain polyethylene yarn in the warp direction has a twist of less than or equal to about 2.0 turns per inch.

8. An article according to claim 7, wherein the entangled extended chain polyethylene yarn in the warp direction has a twist of less than or equal to about 0.50 turns per inch.

9. An article according to claim 1, wherein the air impermeability is less than 5.0 cfm/ft$^2$.

10. An article according to claim 1, wherein the yarn has a denier per filament of at least 1.7.

11. An article according to claim 1, wherein the average number of entanglements per meter of yarn length is about 5 to 55.

12. An article according to claim 1, wherein the article is a parachute.

13. An article according to claim 1, wherein the article is a sail.

14. An article according to claim 1, wherein the article is a glider wing.

* * * * *